US009758360B2

(12) United States Patent
Stanford

(10) Patent No.: US 9,758,360 B2
(45) Date of Patent: Sep. 12, 2017

(54) APPARATUS FOR PROVIDING SAFETY NETTING ON MANLIFTS

(71) Applicant: Billy D. Stanford, Burleson, TX (US)

(72) Inventor: Billy D. Stanford, Burleson, TX (US)

( * ) Notice: Subject to any disclaimer, the term of this patent is extended or adjusted under 35 U.S.C. 154(b) by 263 days.

(21) Appl. No.: 14/049,629

(22) Filed: Oct. 9, 2013

(65) Prior Publication Data

US 2015/0096836 A1 Apr. 9, 2015

(51) Int. Cl.
*B66F 17/00* (2006.01)

(52) U.S. Cl.
CPC ..... *B66F 17/006* (2013.01)

(58) Field of Classification Search
CPC ..... B66F 17/00; B66F 13/00; B66F 17/003; B66F 17/006; E04G 3/32; A01D 46/20; A01D 5/11; A63B 5/11
See application file for complete search history.

(56) References Cited

U.S. PATENT DOCUMENTS 4,127,185 A * 11/1978 Ritter, Jr. ..... 182/140
4,457,403 A * 7/1984 Ream ..... 187/244
4,657,112 A * 4/1987 Ream ..... B66F 11/04 182/127
5,429,206 A * 7/1995 Nusbaum ..... 182/138
5,676,460 A * 10/1997 Biberstine et al. ..... 366/54
5,941,798 A * 8/1999 Coan et al. ..... 482/27
6,044,595 A * 4/2000 Snow ..... 52/101
6,986,621 B2 * 1/2006 Allard ..... 405/36
7,040,838 B2 * 5/2006 Allard et al. ..... 405/36
7,503,372 B1 * 3/2009 Jones ..... 160/351
8,376,086 B1 * 2/2013 Moyer ..... 182/138
8,539,901 B2 * 9/2013 Chittum ..... 114/364
8,794,382 B2 * 8/2014 Hugher ..... 182/187
9,050,482 B1 * 6/2015 VanElverdinghe
2006/0090961 A1 * 5/2006 Rexroad ..... 182/138
2006/0194674 A1 * 8/2006 Hickey ..... 482/27
2008/0269020 A1 * 10/2008 Alexander ..... 482/29
2009/0277721 A1 * 11/2009 Weir ..... 182/115
2009/0308689 A1 * 12/2009 Johnson ..... 182/113
2010/0186159 A1 * 7/2010 Dalickas ..... 4/504
2012/0010050 A1 * 1/2012 Smith et al. ..... 482/27
2012/0077642 A1 * 3/2012 Chen ..... 482/27
2013/0109539 A1 * 5/2013 Chen ..... 482/27
2014/0066259 A1 * 3/2014 Andon et al. ..... 482/27
2014/0102829 A1 * 4/2014 Stearns et al. ..... 182/139
2014/0336005 A1 * 11/2014 Miller ..... 482/27

* cited by examiner

*Primary Examiner* — Katherine Mitchell
*Assistant Examiner* — Shiref Mekhaeil
(74) *Attorney, Agent, or Firm* — Strasburger & Price, LLP

(57) ABSTRACT

A safety apparatus configured for attachment to a manlift and configured to prevent objects falling over the side of the manlift from striking objects and people beneath the manlift. One embodiment includes a frame configured to support netting that is disposed on the platform of an open-sided manlift and angled outward to intercept objects falling vertically outside the surface area of the platform. Another embodiment includes a frame that extends beyond the lip of a dosed-sided manlift and contains netting configured to catch objects falling outside of the surface area of the closed-sided manlift.

15 Claims, 5 Drawing Sheets

APPARATUS FOR PROVIDING SAFETY NETTING ON MANLIFTS

BACKGROUND OF THE DISCLOSURE

1. Field of the Disclosure

This disclosure generally relates to the field of manlift safety.

2. Description of the Related Art

Manlifts are used in numerous applications in many industries. The advantage of a manlift is that it extends the reach of a person inside the manlift while providing a stable, flat platform as a working area, as opposed to the person working on a ladder or suspended. The manlift also provides platform space that may be used for carrying tools or other equipment. Manlifts include different designs such as, but not limited to, scissor lifts, articulated boom lifts, rough terrain lifts, narrow access lifts, telescopic, lifts, push-around lifts, fort lifts, crane lifts, scaffolding lifts, and rolling tower lifts.

Typically, manlifts include safety features to prevent persons within the manlift from falling out. Closed-sided manlifts (also called bucket manlifts) have solid walls to prevent personnel from falling out. Open-sided manlifts have substantially open areas but includes safety features such as toe boards and railing to prevent personnel from falling out. The general focus on manlift safety has been for the person inside the manlift, especially when the task being performed requires the personnel reaching out and extending part of their body beyond the confines of the bucket or safety railing.

One problem with present manlifts is that the safety features focus on the people inside the manlift, but not the people outside, particularly those who may be below the manlift when a tool extended beyond the manlift perimeter falls. Therefore, a need exists for a safety apparatus that will prevent objects from falling when the object is disposed beyond the manlift's perimeter.

BRIEF SUMMARY OF THE DISCLOSURE

One embodiment according to the present disclosure includes an apparatus for preventing objects from falling below an open-sided manlift, the apparatus comprising: a frame comprising: a plurality of horizontal bottom members forming a bottom perimeter configured to align with a perimeter of a platform of the open-sided manlift; a plurality of middle members configured to extend upward and outward from the platform perimeter and attached at substantially right angles to the plurality of horizontal bottom members; and a plurality of horizontal top members aligned to form a top perimeter that is greater than the bottom perimeter and attached to the plurality of middle members at substantially right angles, wherein the top perimeter encompasses a surface area that extends beyond a surface area of the platform; a plurality of attachment devices configured to attach adjacent members; and netting attached between the horizontal bottom members, horizontal top members, and middle members and configured to prevent objects from vertically passing below the platform through a horizontal surface area between the bottom perimeter and top perimeter. The apparatus may also include attachment devices disposed on the horizontal bottom members and configured to attach to a toe board of the open-sided manlift. The attachment devices may comprise at least one of: i) brackets, ii) clips, iii) hook and loop fasteners, iv) plastic ties, v) hinges, and vi) magnets. The apparatus may have a top perimeter that extends outside of a perimeter of an outside railing of the open-sided manlift. Brackets may be attached to the horizontal top members and configured to attach to the railing of the open-sided manlift. The members (horizontal top, horizontal bottom, and middle) may be made of at least one of metal, plastic, fiberglass, composite, and rubber. The members may be rigid or flexible. The attachment devices between the members may be flexible or rigid. The frame may be collapsible. The netting may be held taut or slack between the top perimeter and the bottom perimeter. The netting may be mesh, waterproof, fire resistant, or combinations thereof.

Another embodiment according to the present disclosure includes an apparatus for preventing objects from falling below a closed-sided manlift, the apparatus comprising: a plurality of rectangular frames, wherein each rectangular frame comprises: a plurality of attachment devices configured for mounting on a lip of a closed-sided manlift; an inside frame member attached to the plurality of attachment devices; a plurality of outward frame members attached to the inside member at right angles; and an outside frame member attached to the plurality of outward members at right angles; a plurality of attachment devices configured to attach adjacent members; a first netting disposed between the members and held slack; wherein the rectangular frames are configured to be disposed on adjacent sides of the closed-sided manlift; at least one angled member attached to the outward members of adjacent rectangular frames; and a second netting disposed between the at least one angled member and the outward members of the adjacent rectangular frames and held slack. The rectangular frames may be configured to be disposed along three or more sides of the closed-sided manlift. The attachment devices may comprise at least one of: i) brackets, ii) clips, iii) hook and loop fasteners, iv) plastic ties, v) hinges, and vi) magnets. The members may comprise at least one of: metal, plastic, fiberglass, composite, and rubber. The members may be rigid or flexible, and the attachment devices between the members may be rigid or flexible. One or more of the rectangular frames may be collapsible. The first netting and the second netting may be made of mesh, waterproof material, fire resistant material, and combinations thereof. The apparatus may include support brackets configured to attach the outside and/or outward members to the lip of the closed-sided manlift.

BRIEF DESCRIPTION OF THE DRAWINGS

A better understanding of the present disclosure can be obtained with the following detailed descriptions of the various disclosed embodiments in the drawings, which are given by way of illustration only, and thus are not limiting the present disclosure, and wherein.

DETAILED DESCRIPTION OF THE DISCLOSURE

Figure 1A:
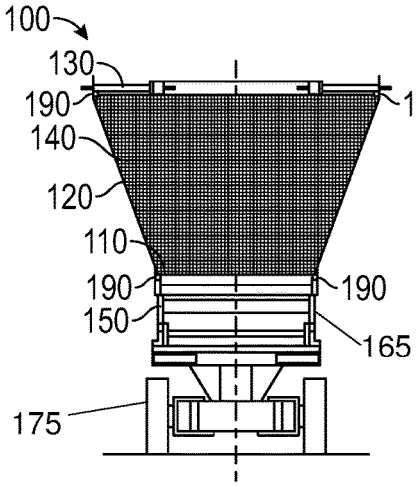
FIG. 1A is a schematic of an open-sided manlift with a safety apparatus according to embodiment of the present disclosure.

Generally, the present disclosure involves a safety apparatus for manlifts. Specifically, the present disclosure is directed to an apparatus of preventing tools and other objects from falling over the side of manlift. The present disclosure is also directed to protecting people and objects below the manlift from damage due to objects falling from the manlift. The present disclosure is susceptible to embodiments of different forms. There are shown in the drawings, and herein will be described in detail, specific embodiments of the present disclosure with the understanding that the present disclosure is to be considered an exemplification of the principles of the present disclosure and is not intended to limit the present disclosure to that illustrated and described herein.

Figure 1B:
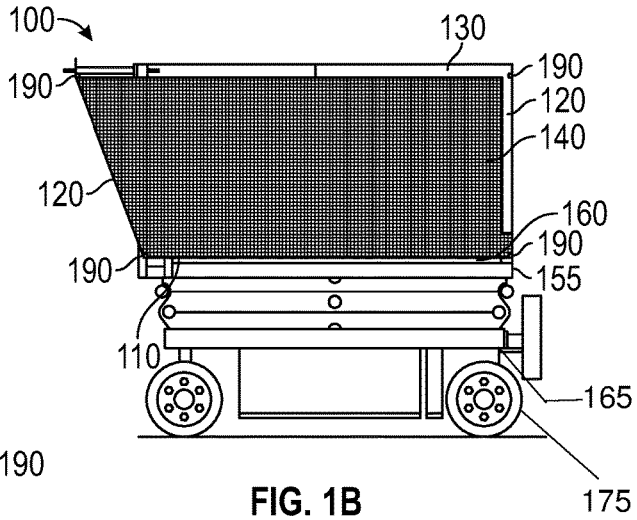
FIG. 1B is a side view of the apparatus from FIG. 1A.

FIGS. 1A-1D show different views of one embodiment of the safety apparatus 100 according to the present disclosure. The apparatus 100 includes a frame made up of horizontal bottom members 110, angled middle members 120, and horizontal top members 130. The frame is configured to be disposed on an open-sided manlift 150. The open-sided manlift 150 includes a platform 155, a lifting mechanism 165 configured to vertically raise/lower the platform 155, and wheels 175. A perimeter formed by the horizontal bottom members 110 is approximately the same size as the surface dimensions of the platform 155. The horizontal bottom members 110 support the angled middle members 120, which are angled outward from the perimeter of the platform 155. The angled middle members 120 may be angled outward relative to one rectangular dimension (FIG. 1B right) or both rectangular dimensions (FIG. 1B left). The horizontal top members 130 are attached to the middle members 120 and form a larger perimeter than the horizontal bottom members 110. The members 110, 120, 130 may be made of rigid or flexible materials. In some embodiments, the members 110, 120, 130 may be made of one or more of: i) metal, ii) plastic, iii) fiberglass, iv) composite, and v) rubber.

The members 110, 120, 130 may be attached to one another using any attachment means 190 known to a person of ordinary skill in the art. The attachment means 190 may be rigid or flexible. In some embodiments, the attachments may be configured so that the frame is collapsible. In some embodiments, the frame may be configured to partially collapse in one or more directions, such that, the frame will collapse on one side of the open-sided manlift 150 while maintaining position on the other sides when the open-sided manlift 150 is positioned against the face of a structure, such as a building. This allows the apparatus 100 to continue to operate while the open-sided manlift 150 is positioned for close-in work on a structure.

The horizontal bottom members 110 may be attached to the open-sided manlift 150 at a toe hoard 160. The attachment between the bottom members 110 and the toe board 160 may be any suitable attachment mechanism as understood by a person of ordinary skill in the art, including, but not limited to, brackets, clips, hook and loop fasteners, plastic ties, hinges, and magnets.

Netting 140 may be disposed between the members 110, 120, 130. The netting 140 may be configured so that the horizontal plane formed between the perimeter of the horizontal top members 130 and the perimeter of the horizontal bottom members 110 intercepts falling objects that would otherwise fall below the height of the platform 155. The netting 140 may be configured as taut or slack. When the netting 140 is sufficiently taut, objects that are intercepted by the netting 140 will be redirected onto the platform 155 by sliding down the netting 140. If the netting 140 is sufficiently slack, a falling object may be captured by a pocket formed by the netting 140 along side the toe board 160 or next to the platform 155. The netting 140 may be a water resistant material (i.e. canvas), a mesh, or a combination thereof. The netting 140 may be made of a waterproof material. The netting 140 may be made of a fire resistant material. The netting 140 is configured to prevent the passage of small macroscopic objects. In some embodiments, the netting 140 may be made of nylon or polyester.

Figure 1C:
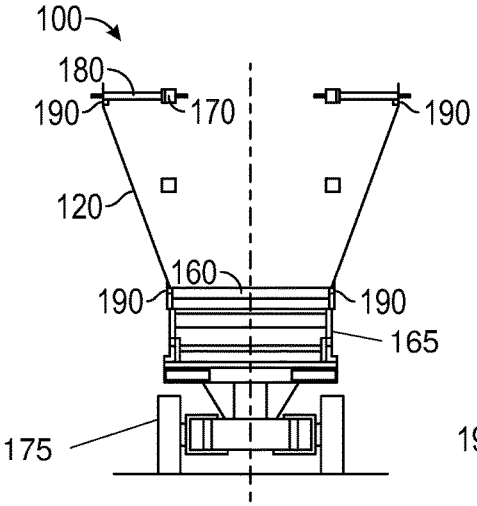
FIG. 1C is an interior view of a cross-section of the apparatus from FIG. 1A taken from line A-A of FIG. 1D.
Figure 1D:
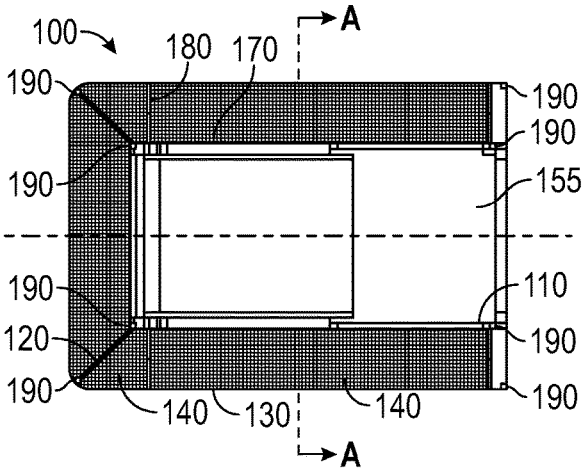
FIG. 1D is a top view of the apparatus from FIG. 1A.

As seen in FIG. 1C, in some embodiments, the open-sided manlift 150 may include a railing 170, and the apparatus 100 may include standoff members 180 configured to maintain the position of the horizontal top members 130 at a selected distance from the railing 170, thus, maintaining the area of the horizontal area where falling objects may be intercepted. The selected distance may be selected to be approximately a human arm length. In some embodiments, the selected distance may be 24 inches. It is also contemplated that the apparatus 100 may be held in position on the open-sided manlift 150 by the standoff members 180 and the no toe board 170 attachment be required.

Figure 2:
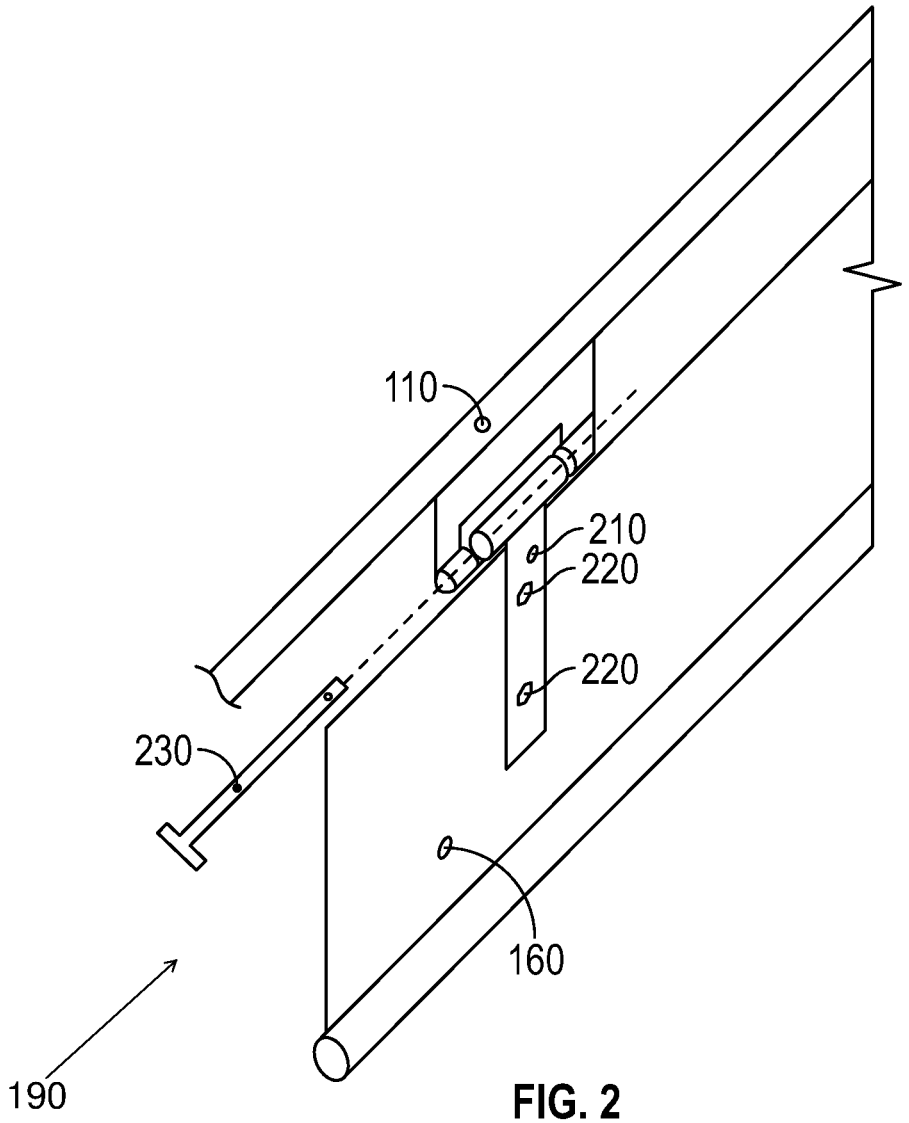
FIG. 2 is an exemplary toe board attachment for the safety apparatus according to one embodiment of the present disclosure.

FIG. 2 shows an exemplary attachment means 190 between the horizontal bottom member 110 and the toe board 160. Here a hinge bracket 210 is attached to the toe board 160 using bolts 120 and similarly attached to the horizontal bottom member 110. The hinge bracket 210 is secured with a pin 230 to complete the attachment. In some embodiments, the attachment of the horizontal bottom member 110 and the toe board 160 may include a hold open hinge.

Figure 3A:
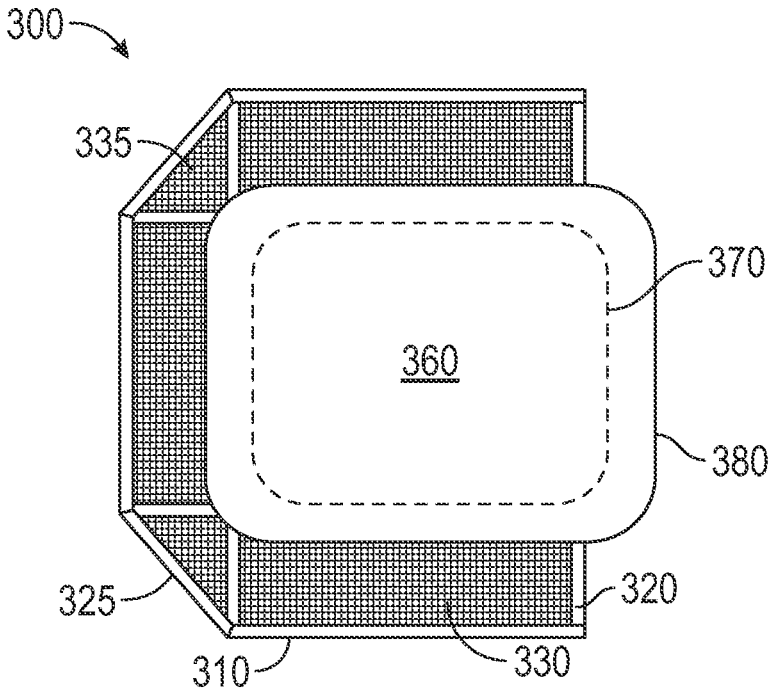
FIG. 3A is top view of another embodiment of the safety apparatus on a closed-sided manlift according to one embodiment of the present disclosure.
Figure 3B:
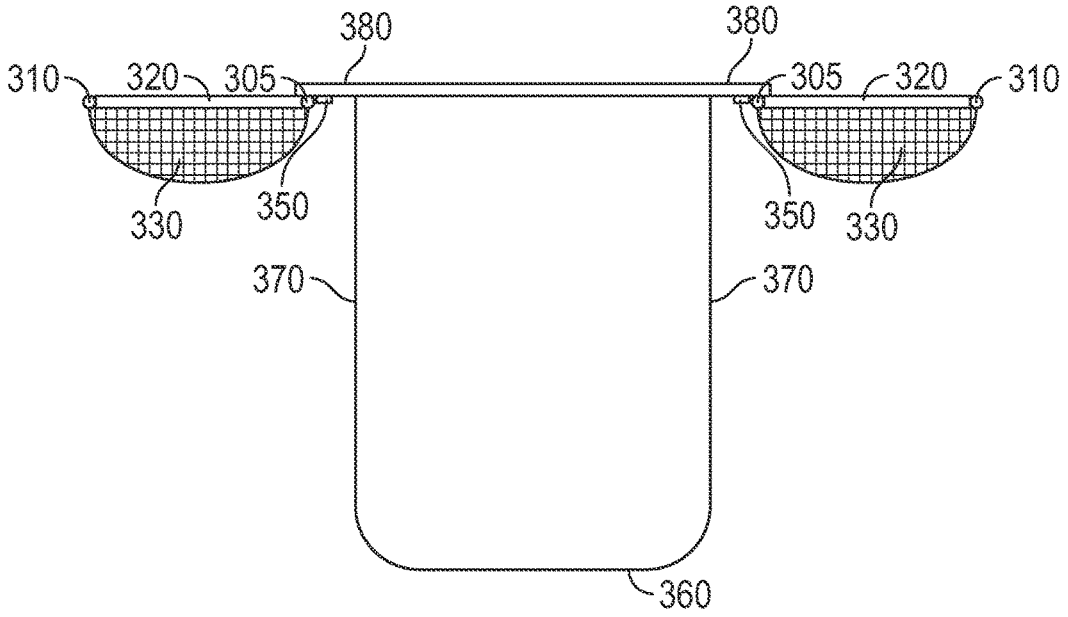
FIG. 3B is a side view of FIG. 3A.

FIGS. 3A and 3B show schematics of a safety apparatus 300 for a closed-sided manlift made up of a platform 360, closed sides 370, and a lip 380. The safety apparatus 300 may include a set of horizontal rectangular frames made up of inside members 305, outside members 310, and outward members 320. The horizontal rectangular frames may be attached to netting 330 such that netting 330 is configured to catch falling objects. The netting 330 may be similar in composition and structure as the netting 140. Angled outward members 325 may be used to attach netting 335 for providing continuous netting coverage around corners of the manlift. In some embodiments, the members 305, 310, 320, 325 may be made of one or more of: i) metal, ii) plastic, iii) fiberglass, iv) composite, and v) rubber. The outward members 320, 325 are configured with sufficient stiffness to support the weight and torque of at least the horizontal rectangular frame and the netting 330, 335. In some embodiments, the stiffness of the outward members 320, 325 may be sufficient to support the weight and torque of the horizontal rectangular frame, the netting 330, 335, and small objects that may fall into the netting 331, 335.

The inside members 305 may be supported by an attachment mechanism 350 connected to the lip 380. Suitable attachment mechanisms 350 may include, but are not limited to, hooks, brackets, clips, and plastic ties. The outward members 320, 325 may be attached to a suitable attachment mechanism 350 (the same or different from the attachment mechanism corresponding to the inside members 305). The outside members 310 are supported by the outward members 320, 325. The members 305, 310, 320, 325 may be rigid or flexible (such as cable). In some embodiments, the horizontal rectangular frames may be disposed on two, three, or four sides of the closed-sided manlift. In some embodiments, the horizontal rectangular frame members 305, 310, 320, 325 may have flexible attachments such that the apparatus 300 is collapsible and so that the apparatus 300 is not damaged if the closed-sided manlift is too close to a structure (such as a wall). In some embodiments, the flexible attachments may include compression springs configured to 1) maintain the shape of the horizontal rectangular frame when nominal force is applied to the horizontal rectangular frame and 2) allow the horizontal rectangular frame to at least partially collapse when lateral force is applied to the horizontal rectangular frame (as in encountering the surface of a building).

Figure 3C:
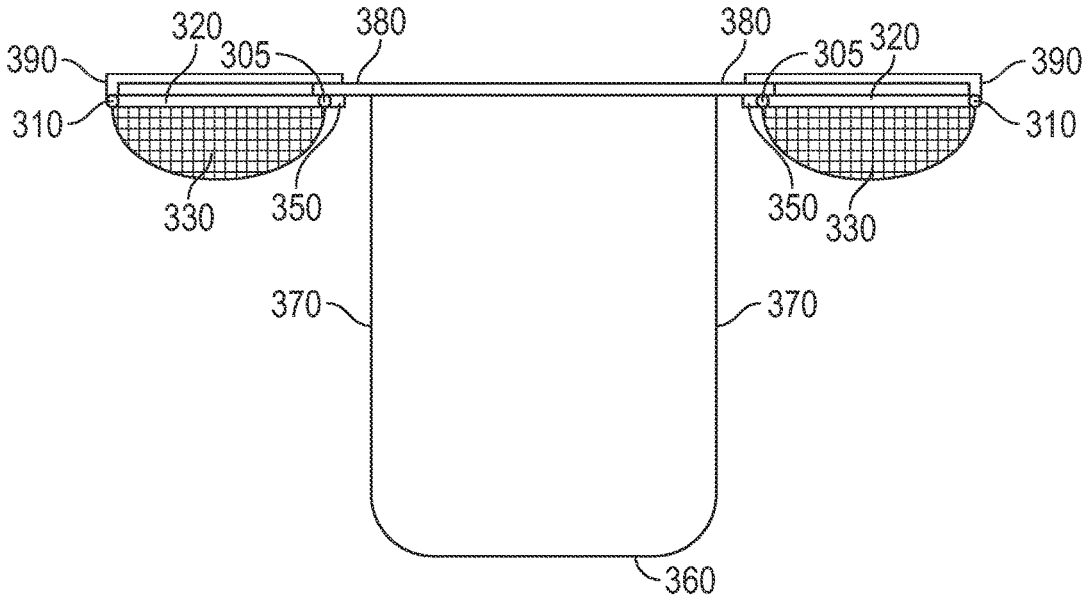
FIG. 3C is a side view of FIG. 3A with optional support brackets.

FIG. 3C shows a schematic of the safety apparatus 300 with optional supports 390 attached to the lip 380 and configured to support the horizontal rectangular frame at a selected distance or distances from the lip 380. The supports 390 may be attached to one or more of the outside members 310, the outward members 320, or both. The supports 390 may be attached to the members 310, 320 and the lip 380 using any of the aforementioned attachment mechanisms as would be known to a person of ordinary skill in the art.

The foregoing disclosure and description of the disclosure are illustrative and explanatory thereof, and various changes in the details of the illustrated apparatus and apparatus, and the construction and the method of operation may be made without departing from the spirit of the disclosure.

What is claimed is:

1. An apparatus for preventing objects from falling, the apparatus comprising:

an open-sided manlift comprising:

a platform;

a toe board disposed around a perimeter of the platform;

a railing disposed on and around the platform;

a height adjusting mechanism disposed below the platform and configured to vertically raise/lower the platform;

a frame comprising:

a plurality of horizontal bottom members forming a bottom perimeter configured to align with a perimeter of the platform of the open-sided manlift;

a plurality of middle members configured to extend upward and outward from the platform perimeter and attached at a first angle to the plurality of horizontal bottom members; and a plurality of horizontal top members aligned to form a top perimeter that is greater than the bottom perimeter and attached to the plurality of middle members at a second angle, wherein the top perimeter encompasses a top perimeter surface area that extends beyond a bottom perimeter surface area of the platform;

a plurality of attachment devices configured to attach the horizontal bottom members to the middle members and to attach the horizontal top members to the middle members, said attachment devices are configured so that the frame is collapsible in one or more directions, wherein the frame collapses on one side of the open sided manlift while maintaining position on other sides when the open-sided manlift is positioned against a face of a structure; and a netting attached between the horizontal bottom members, horizontal top members, and middle members and configured to prevent objects from vertically passing below the platform through the top perimeter surface area between the bottom perimeter and the top perimeter.

2. The apparatus of claim 1, further comprising toe board attachment devices disposed on the horizontal bottom members and configured to attach to the toe board of the open-sided manlift.

3. The apparatus of claim 2, wherein the attachment devices comprise at least one of: i) brackets, ii) clips, iii) hook and loop fasteners, iv) plastic ties, v) hinges, or vi) magnets or combinations thereof.

4. The apparatus of claim 2, wherein the toe board attachment devices along at least a portion of the perimeter of the platform are flexible and configured to allow at least part of the frame corresponding to the flexible toe board attachment devices to collapse toward the railing by allowing the at least part of the frame to pivot on the flexible toe board attachment devices.

5. The apparatus of claim 1, wherein the top perimeter is configured to extend beyond a perimeter formed by the railing of the open-sided manlift.

6. The apparatus of claim 1, wherein the members comprise at least one of the devices: metal, plastic, fiberglass, composite, or rubber or combinations thereof.

7. The apparatus of claim 1, wherein one or more of the horizontal top members, the horizontal bottom members, or the middle members are rigid.

8. The apparatus of claim 1, wherein one or more of the attachment devices between the horizontal top members, the horizontal bottom members, or the middle members are rigid.

9. The apparatus of claim 1, wherein one or more of the horizontal top members, the horizontal bottom members, or the middle members are flexible.

10. The apparatus of claim 1, wherein the netting is configured to be held taut between the top perimeter and the bottom perimeter.

11. The apparatus of claim 1, wherein the netting is configured to be held slack between the top perimeter and the bottom perimeter.

12. The apparatus of claim 1, wherein the netting comprises a mesh.

13. The apparatus of claim 1, wherein the netting comprises a waterproof material.

14. The apparatus of claim 1, wherein the netting comprises a fire resistant material.

15. The apparatus of claim 1, further comprising wheels coupled to the lifting mechanism.

* * * * *